US005477560A

United States Patent [19]

Shope

[11] Patent Number: 5,477,560

[45] Date of Patent: Dec. 26, 1995

[54] COMBINATION BIB AND FOLD-UP TOY DEVICE

[76] Inventor: G. Alan Shope, 3609 Stayton, Independence, Mo. 64055

[21] Appl. No.: 296,663

[22] Filed: Aug. 26, 1994

[51] Int. Cl.[6] ..... A41B 13/10

[52] U.S. Cl. ..... 2/49.1; 2/75; 2/80; 2/69; 446/28; 446/26

[58] Field of Search ..... 2/46, 47, 48, 49.1, 2/49.2, 49.3, 49.4, 49.5, 50, 51, 52, 75, 80, 83, 104, 105, 106, 69, 69.5, 912, 913, 914, 915, 88, 89, 90, 86, 72, 115; 446/26, 27, 28

[56] References Cited

U.S. PATENT DOCUMENTS

| | | | |
|---|---|---|---|
| D. 312,584 | 12/1990 | Meyer . | |
| D. 352,595 | 11/1994 | Cameron | D2/863 |
| 1,526,322 | 2/1925 | Denne | 2/46 |
| 2,145,139 | 1/1939 | Scharfenberg | 2/46 |
| 2,389,596 | 11/1945 | Chamas et al. | 2/50 X |
| 4,068,313 | 1/1978 | Goldman . | |
| 4,165,542 | 8/1979 | McLaughlin | 2/209.1 |
| 4,829,601 | 5/1989 | Spanier . | |
| 4,905,714 | 3/1990 | Drennen . | |
| 5,046,980 | 9/1991 | Tai et al. | 2/49.4 X |
| 5,201,073 | 4/1993 | Spanier . | |
| 5,244,278 | 9/1993 | Robitaille | 2/49.2 X |
| 5,312,282 | 5/1994 | Cooper | 2/49.2 |

*Primary Examiner*—Jeanette E. Chapman
*Attorney, Agent, or Firm*—Stinson, Mag & Fizzell

[57] ABSTRACT

A combination bib and toy device which is comprised of any suitable nonrigid material. The device may include a toy in the form of a human figure or may take the form of an animal or other nonhuman character. The toy figure is attached to the nonworking side of a bib body, preferably by sewing, or other suitable means. When the device is worn around a child's neck as a bib, the positioning of the toy figure prevents the toy figure from becoming soiled and prevents the child from playing with the toy while eating. When not being worn as a bib, the novel design allows the bib body and other extrusions to fold quickly and neatly inward so that an unsoiled toy becomes prominent. The combination bib and toy device reduces the number of children's items that must be carried away from home and is easily stored among other items without contaminating them.

21 Claims, 4 Drawing Sheets

COMBINATION BIB AND FOLD-UP TOY DEVICE

FIELD OF THE INVENTION

The present invention relates to protective coverings for children's clothing, such as bib devices, which are also used alternatively as toy devices, such as dolls.

BACKGROUND OF THE INVENTION

Toys which function as bibs and bibs which function as toys are known in the prior art. U.S. Pat. No. 5,046,980 is an example of the former, a toy device with pull-out bib, which issued to Woon S. Tai et al. on Sep. 10, 1991. Tai et al. '980 discloses a hollow animal-shaped container with an integrated carrying handle in which the hollow container stores a roll-up bib until the bib is ready to be used. Examples of combination toddler bib and doll devices include U.S. Pat. Nos. 4,829,601 and 5,201,073, both of which issued to M. Spanier on May 16, 1989 and Apr. 13, 1993, respectively. Spanier '601 discloses a toddler bib which includes a three-dimensional doll fashioned by applying a three-dimensional face to the body of the bib and affixing doll arms and legs to the bib so that the child may be amused by a three-dimensional doll while eating. Spanier '073 discloses the addition of a storage pocket and removable holder to the rear of the combination toddler bib and doll device described in Spanier '601 so that additional children's items may be stored. U.S. Pat. No. 4,068, 313, issued to D. Goldman on Jan. 17, 1978, discloses a child's bib with an article of use, such as a toy, tethered to the bib to prevent the loss or contamination of the attached article while the bib is being worn.

Each of the above inventions, either separately or in combination, acknowledges a need to make the feeding experience as pleasant as possible for both child and adult, while minimizing the mess created by young children during feeding. These devices seek to satisfy this need by combining the protective bib with a toy device—thereby associating a positive amusement experience (symbolized by the toy device) with an often negative feeding experience (symbolized by the bib).

An unrelated need also acknowledged by the prior art is that the amount of children's clothing, toys and related paraphernalia that supervising adults can carry is necessarily limited. As a result, useful and essential children's articles, like toys and bibs, that serve multiple functions are in demand because they optimize the use of an adult's fixed carrying capacity.

Prior art devices, however, do not disclose or suggest attaching a toy figure to the nonworking side of a bib body nor do such prior devices anticipate a bib being folded up to constitute a toy while also fully containing the messy working side of the bib body after feeding. As a result, the prior art devices do not achieve either of the aforementioned long-felt needs. In fact, the prior art teaches away from the current novel invention by disclosing and encouraging playing with toy devices simultaneously with feeding. This necessarily develops a desire in a child to play with the food, rather than to eat the food dutifully and thus creates more, not less, soiling of the child's surroundings, including the bib itself. This renders the entire experience less positive for both the adult—who must clean up the mess created—and the child—whose toy becomes soiled and which toy must be cleaned before further play is possible. Moreover, since the prior art teaches and encourages play with the toy during eating, the toy will inevitably be soiled during feeding. This aggravates, rather than alleviates, the storage problem since additional clean toys must be carried to amuse the child after feeding and additional capacity is needed to segregate the now-soiled combination bib and toy device from other clean items to prevent secondary contamination.

Until now, no combination bib and toy device has been able to invoke a positive feeding experience without also soiling the attached toy device. The prior art does not teach or suggest a means, desire or objective of preventing the toy from being soiled during feeding. The present invention assures that the toy remains clean during feeding by affixing it to the nonworking side of the bib body. In addition, no previous combination bib and toy device fully alleviates the storage problem inherent with soiled bibs or soiled toys. The present invention is the first device to incorporate a folding design that enables the soiled working side of the bib to be completely enclosed within a still-clean toy when the bib is reconfigured into an amusing toy in a matter of seconds by means of a few simple folds.

SUMMARY OF THE INVENTION

The present invention is an improved combination bib and toy device comprised of a reusable bib body and a toy figure or doll attached to the bib body's nonworking side. The toy figure becomes prominent after the bib body is folded after being used during a child's feeding. This novel device overcomes the disadvantages inherent with other known combinations of bib and toy devices. The present invention includes a bib body having a cutout top and a working and nonworking side, a toy body that is smaller in size when compared to the bib body's size, and extensions connected to the toy body and located at the cutout top for securing the bib body around a child's neck. When so attached, the toy body is not exposed such that when feeding the child the toy body does not get soiled.

After feeding, the bib body is removed from the child's neck, neatly folded and then completely enclosed and secured with the use of snaps, buttons or VELCRO within the still clean toy body. The toy body can then be given to the child for play.

Accordingly, it is a principle object of this new device to enhance a child's feeding experience without encouraging the child to play with food and without soiling the toy. This invention accomplishes this by restricting play with the toy to periods before or after—but not during—the feeding period. The invention, by locating the attached toy figure on the nonworking side of the bib body, assures that the toy figure is fully protected and inaccessible to the child when said device is being used as a bib during feeding. Not only does this unique device discourage, rather than encourage, playing with food, but the device also assures the toy remains clean. Another object of the present invention is to enhance the feeding experience by positively associating the image of a bib with an amusing toy device so that the child looks forward to feedings and does not struggle when an adult attempts to secure the bib to the child.

Still another object of this invention is to minimize the number of useful items that adults must carry with them to attend to the needs of children while away from home; to provide for a bib and toy device that folds the bib when soiled inward to create a clean and amusing toy after feeding; and to obviate the need to carry additional toys by covering and securing a soiled bib within a bib and toy device such that a child can play with a still clean toy after the bib has been used during a feeding.

Additionally, another object is to provide for a bib and toy device that can have a soiled bib body folded inward leaving a still clean toy that can be stored alongside other unsoiled items without need for further segregation or risk of secondary contamination. Other objects of the invention will become apparent from the detailed description or subsequently discovered by and through this disclosure.

DESCRIPTION OF PREFERRED AND ALTERNATIVE EMBODIMENTS

Figure 2:
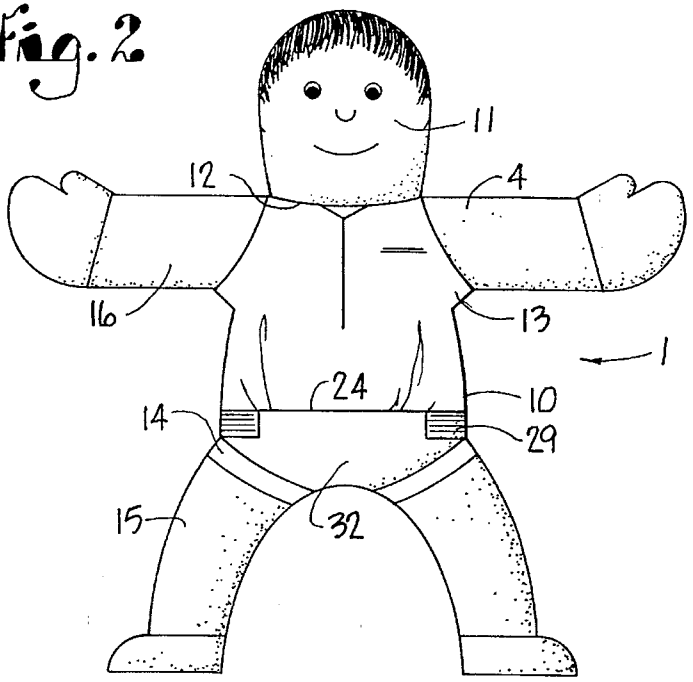
FIG. 2 is a front perspective view of the device in a folded (closed) configuration showing the preferred embodiment of a doll-like toy.

The detailed embodiments of the present invention are disclosed herein; however, it is to be understood that the disclosed embodiments are merely exemplary of the invention which may be embodied in various forms so that specific structural or functional details disclosed herein are not to be interpreted as limiting, but merely as a basis for the claims and as a representative basis for teaching one skilled in the art to variously employ the present invention in virtually any appropriately detailed structure.

DETAILED DESCRIPTION

Figure 1:
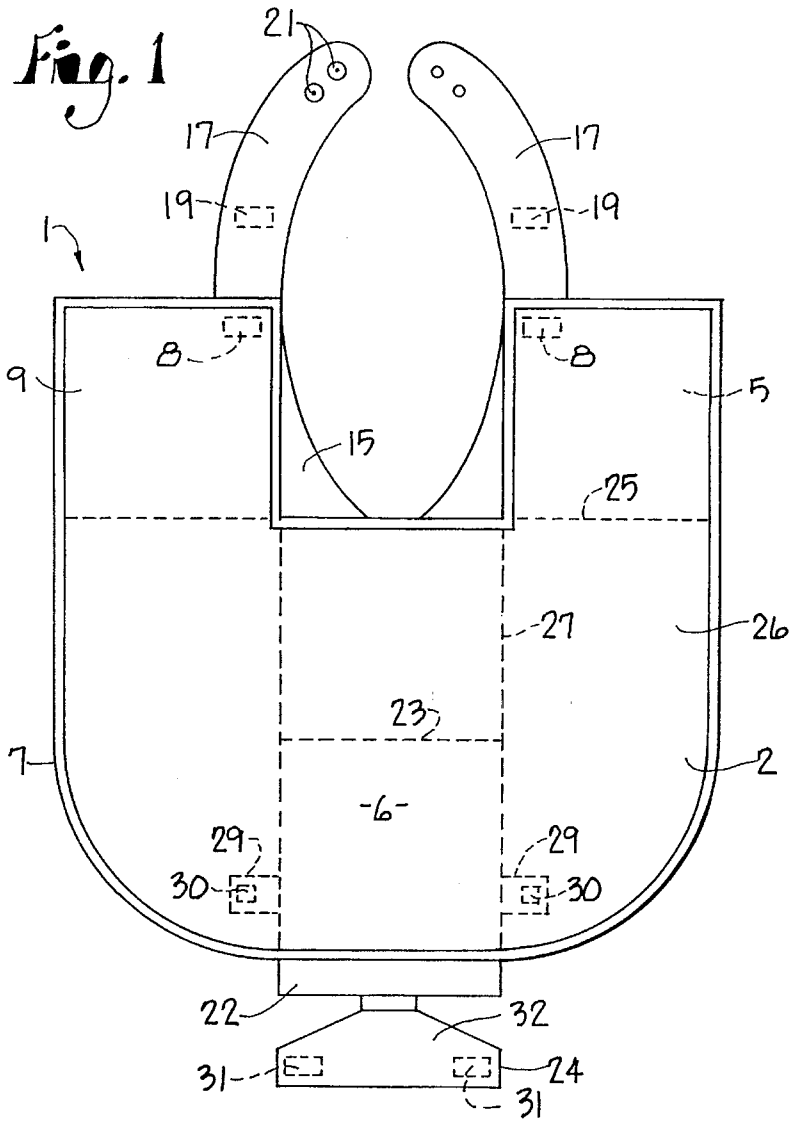
FIG. 1 is a front plan view of the device in an unfolded (open) configuration showing a bib body with a fastening means.
Figure 4:
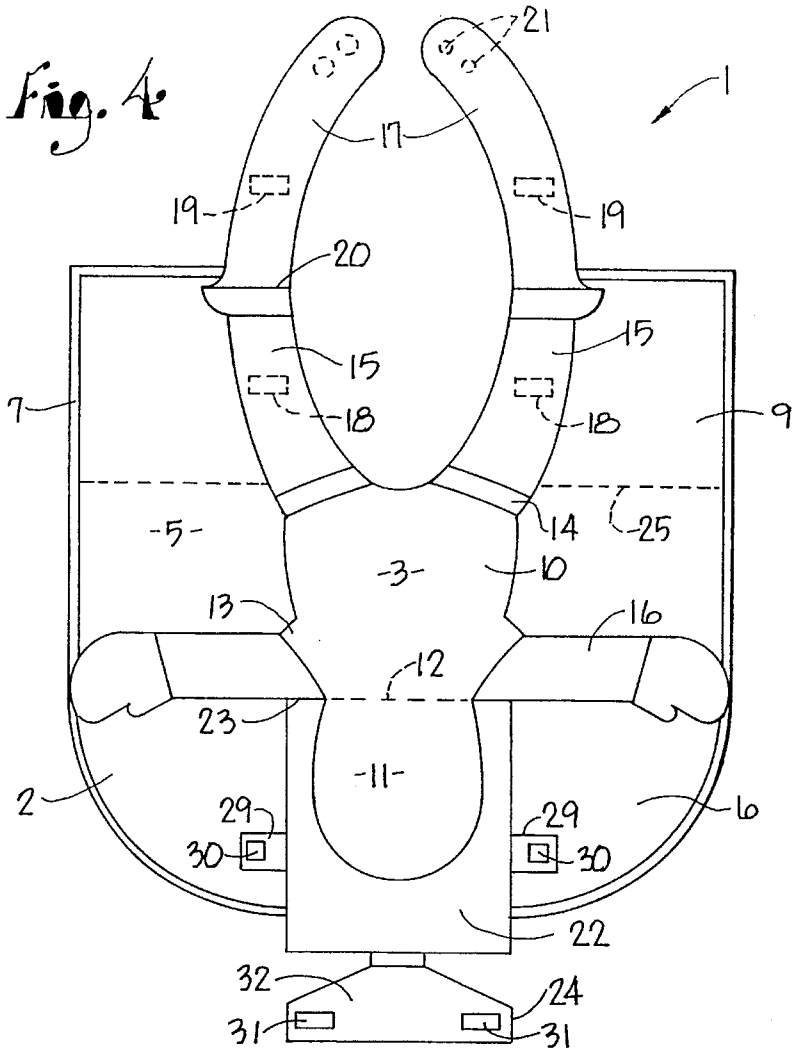
FIG. 4 is a back plan view of the device in an unfolded (open) configuration.
Figure 3:
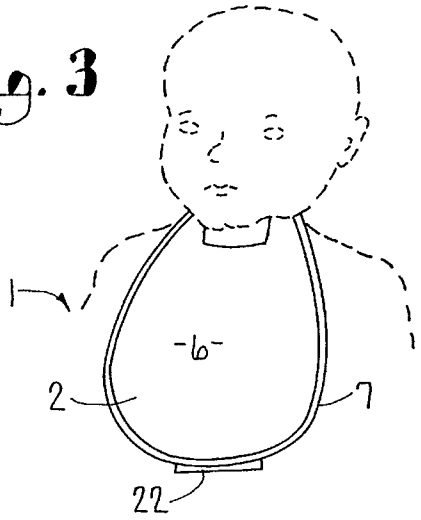
FIG. 3 is a front perspective view of the device while engaged about the neck of a child and in use as a bib.
Figure 6:
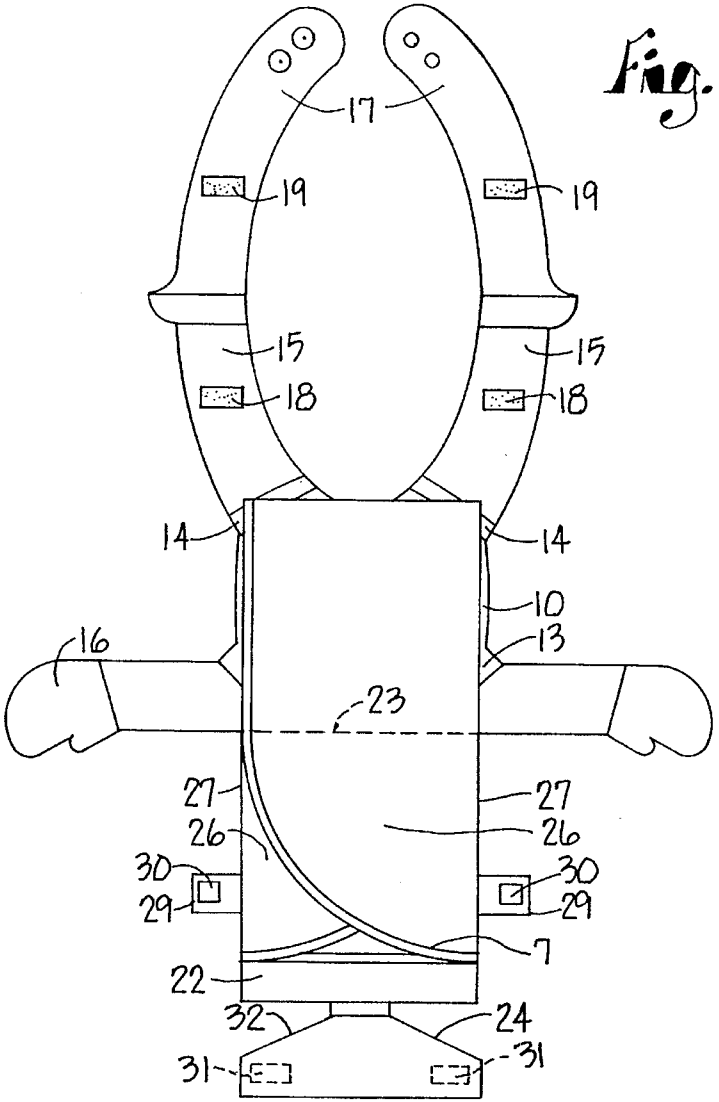
FIG. 6 is a front plan view of the device after the intermediate folds of the bib body are completed.

Referring to the drawings in more detail:

FIGS. 1–8 describe the preferred embodiment of the present invention, generally indicated as a combination bib and toy device 1. Specifically, FIGS. 1 and 2 show the device 1 in its unfolded, open configuration, as a bib 2, and in its folded, closed configuration, as a toy 4, respectively. Throughout the following description, the toy 4 may be described as a doll in the form of a human figure; however, in future or alternative embodiments, the toy 4 could also take the form of an animal figure or another nonhuman character. As depicted in FIG. 3, the bib 2 is to be worn against a child's chest. As shown in FIG. 4, the bib 2 has a toy body 3 on the nonworking side 5 of the bib 2 which prevents the toy body 3 from being soiled and to avoid any distractions to the child during feeding. All materials used in the invention are comprised of any suitable nontoxic material, such as, but not limited to, terry cloth material, quilting material, plastic, nylon, rayon, polyester, or any blend or combination thereof.

FIGS. 1, 3 and 4 portray a bib body 6 comprised, in the preferred embodiment, of a single panel of terry cloth material and lined with border 7, comprised of Bias tape which is contoured around the outer perimeter of bib body 6 and attached by sewing. As shown in FIG. 1, VELCRO fasteners 8 are attached to the nonworking side 5 of the bib flaps 9 by sewing. Depicted in FIGS. 4, 5, 7 and 8, toy body 3 is sized to be approximately one-third the width of bib body 6, and, as exemplified in FIG. 4, toy body 3 is desirably attached between the bib flaps 9 to the bib body 6 by sewing. Toy body 3, illustrated in FIGS. 2 and 4 and embracing a doll torso 10 and doll head 11, is desirably comprised of two identically-shaped panels of terry cloth material affixed to one another by sewing, thereby comprising a single unit of twice the normal thickness of terry material. As portrayed in FIGS. 2 and 4, in affixing toy body 3 to bib body 6, only doll torso 10 is specifically attached to bib body 6, leaving doll head 11 to freely pivot along seam line 12 formed by so attaching doll torso 10.

Referring to FIGS. 2, 4 and 6–8, elastic tabs 13 and 14, respectively, comprised of any suitable elastic material, are attached by sewing to doll torso 10. As shown in FIGS. 2 and 4–8, doll legs 15, desirably comprised of terry material, are attached to elastic tabs 14 by sewing or other suitable means. Similarly, as depicted in FIGS. 2, 4 and 6–8, doll arms 16, desirably comprised of terry material, are attached to elastic tabs 13, preferably by sewing. As depicted in FIGS. 1 and 4–7, extensions 17, desirably comprised of terry material, are attached to doll legs 15, preferably by sewing.

Figure 5:
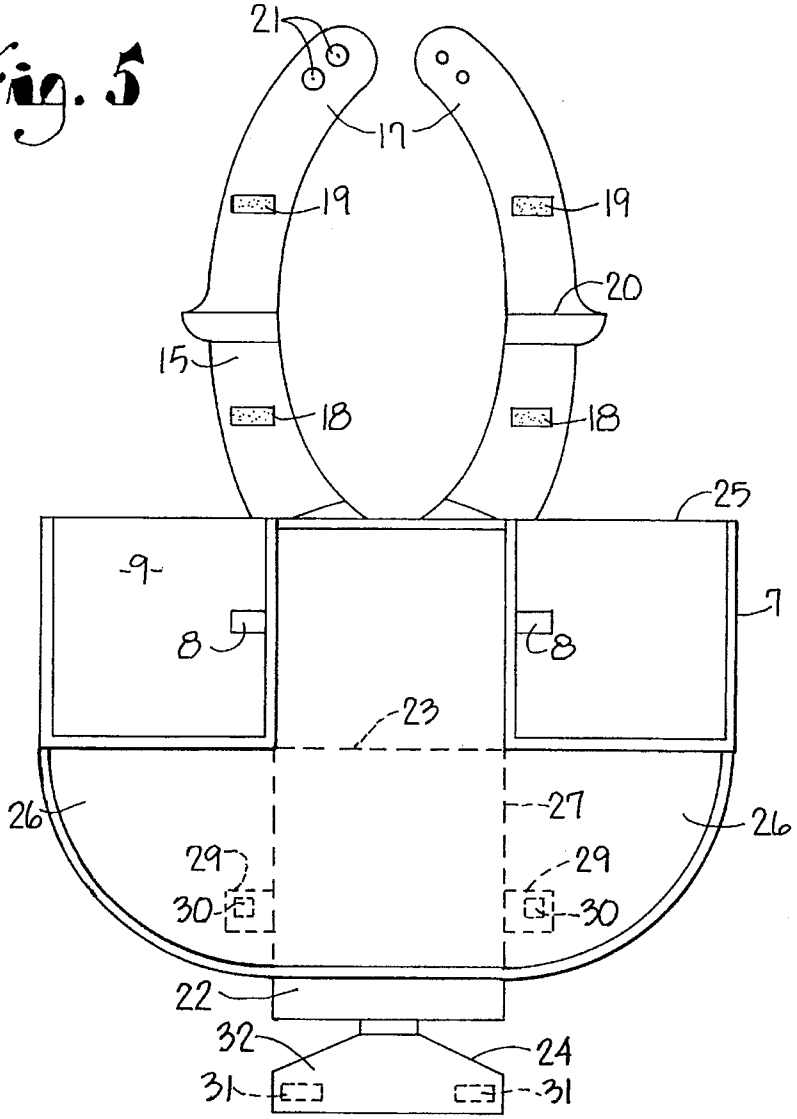
FIG. 5 is a front plan view of the device after the first folds of the bib body are completed.
Figure 8:
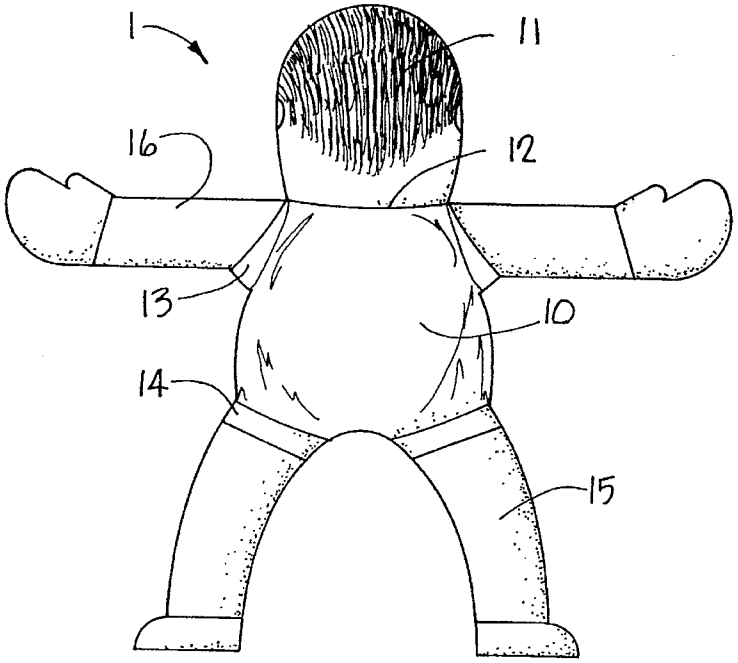
FIG. 8 is a back perspective view of the device in a folded (closed) configuration showing the preferred embodiment of a doll-like toy.

As shown in FIGS. 4–7, VELCRO fasteners 18 are attached to the inner side of doll legs 15, by sewing or other means, and are not visible when viewing the nonworking side 5 of the bib 2. Pictured in FIGS. 4 and 5, VELCRO fasteners 18 are positioned on doll legs 15 in such manner as to be directly aligned with VELCRO fasteners 8 that are attached to bib body 6 as described earlier and, when doll legs 15 are pressed against bib body 6, VELCRO fasteners 8 and 18 work in tandem to hold doll legs 15 against bib body 6. Represented in FIGS. 4–7, VELCRO fasteners 19 are desirably positioned on extensions 17 in such manner as to be directly aligned with VELCRO fasteners 18 when extensions 17 are folded along attachment seams 20 and pressed against doll legs 15. As shown in FIG. 4, VELCRO fasteners 19 are attached to extensions 17, preferably by sewing, and are not visible when viewing the nonworking side 5 of the bib 2. Shown in FIGS. 1 and 4–5, snaps 21 are affixed to extensions 17 by any means and positioned in such manner that they align with each other and work in tandem to engage the device 1 about the neck of a child, as shown in FIG. 3. Described in FIGS. 1 and 4–7, a rectangular back flap 22 is attached by sewing to bib body 6 along seam line 23 and arranged behind doll head 11, parallel to seam line 12*a*, formed by doll torso 10 and bib body 3, as shown in FIG. 5. Back flap 22 is desirably comprised of terry material and preferably sized to be approximately the same width as doll torso 10 and no longer than doll torso 10 so that back flap 22 does not extend down below the bottom edge of doll torso 10 when back flap 22 is folded. Portrayed in FIGS. 1 and 4–7, attachment tab 24 is affixed to the bottom of back flap 22, preferably by sewing, and is desirably comprised of VELCRO.

Elastic tabs 29, desirably comprised of any suitable elastic material, are affixed, preferably by sewing, to each of the sides of back flap 22. The elastic tabs 29 are positioned in such a manner that they are aligned, when folded over the doll torso 10, directly above and adjacent to the elastic tabs 14 of the doll legs 15. The elastic tabs 29 have VELCRO fasteners 30 attached thereto, by sewing or other means.

Attachment tab 24 is preferably comprised of a single panel of terry cloth material. Attachment tab 24 is sized to be approximately the same size and shape of the bottom most portion of the doll torso 10, when folded over the doll torso 10 as depicted in FIG. 2. As shown in FIGS. 1 and 2, VELCRO fasteners 31 are attached, by sewing or other means, to the outer side 32 of the attachment tab 24. When attachment tab 24 is folded over the doll torso 10, it is positioned in such a manner that it aligns itself adjacent to the elastic tabs 14 as shown in FIG. 2. The VELCRO fasteners 30 are desirably positioned, when the elastic tabs 29 are folded over the doll torso 10 and attachment tab 24, in such a manner as to be directly aligned with VELCRO fasteners 31 that are affixed to attachment tab 24. As shown in FIG. 2, VELCRO fasteners 30 and 31 work in tandem to hold the attachment tab 24 against the doll torso 10. Attachment tab 24 can also be connected to elastic tabs 29 by having VELCRO fasteners 30 align and attach to VELCRO fasteners 31. Attachment tab 24 can thereby be connected to elastic tabs 29 while being covered by the bib body 6, as shown in FIG. 3.

OPERATION AND USE

Turning now to the use and operation of the combination bib and toy device 1 of the present invention, as shown in its unfolded open configuration in FIGS. 1 and 3, the device 1 can be used as a protective covering (bib) for children's clothing while feeding. The bib body 6 has a size that is larger than the toy 4 such that the bib body 6 provides a covering to protect the toy 4 during the feeding of a child. Through a simple combination of folds, device 1 converts into a useful and amusing doll or toy 4, represented in FIGS. 2 and 8. Because the child is able to use device 1 as a toy when device 1 is not being used as a bib, a positive association naturally develops between the child's amusement and feeding experiences so that the child is pleased when the adult takes out combination bib and toy device 1 in preparation for feeding. This reduces the stress and anxiety normally present for both parent and child before and during feeding.

Figure 7:
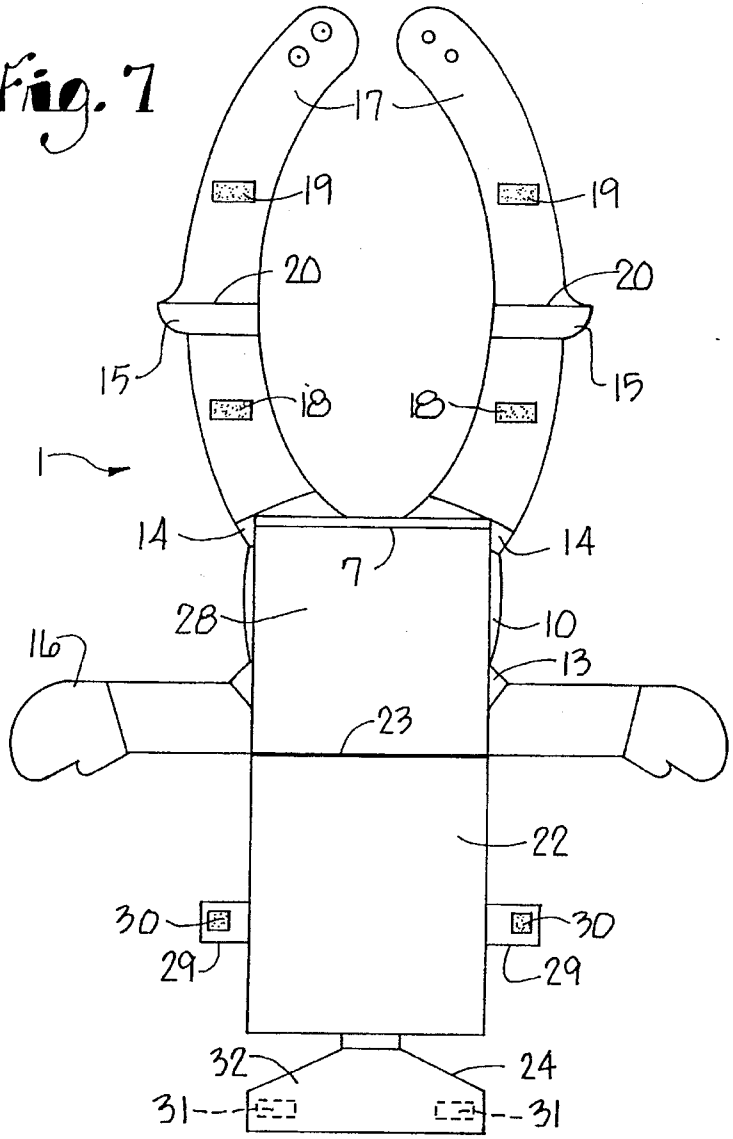
FIG. 7 is a front plan view of the device after all folds of the bib body are completed and revealing a back flap.

FIG. 5 shows the initial steps to reconfigure the bib into a doll, wherein VELCRO fasteners 8 and 18 are separated from one another so that bib flaps 9 can be folded along seam lines 25. As displayed in FIG. 6, bib sides 26 are folded inward along folding lines 27. Next, as shown in FIG. 7, bib top 28 is folded inward along seam line 23, which assures that the working side of bib body 6 is no longer exposed. The doll is completed by folding extensions 17 along attachment seams 20 so that VELCRO fasteners 18 and 19 are joined; and back flap 22 is folded inward along seam line 23. Lastly, as delineated in FIGS. 2 and 8, attachment tab 24 is secured to elastic tabs 29 by joining VELCRO fasteners 30 and 31 to complete the toy. Viewed in FIGS. 2 and 8, a complete, three-dimensional doll is thusly created by this series of folds.

By folding the bib body 6 and extensions 17 in the manner just described, the exterior surface of the doll remains clean, even after feeding. This permits its use as a toy device by the child without any further need for cleaning by the parent. Since the child can immediately begin playing with the doll after feeding, the positive images between amusement and feeding are further reinforced. Additionally, since the device, in its folded configuration as a doll, is still clean after feeding, there is no need to bring additional clean toys away from home. The child can be amused by the doll device after feeding.

Similarly, if the doll or toy 4 needs to be used as a bib 2, then the bib body 6 and extensions 17 are unfolded, thereby creating a ready-to-use bib 2. The attachment 24 is again secured to elastic tabs 29 by joining VELCRO fasteners 30 and 31 to ensure the attachment 24 is beneath the bib body 6 when the bib 2 is to be used for feeding a child. This ensures the exterior surface of the doll remains clean.

Storage of the combination bib and toy device can be accomplished without segregating the device from other clean items thereby optimizing one's limited carrying and storage capacity.

The bib and toy act harmoniously together as one unit in combination. Parents may bring this single useful item with them while away from home to minimize the number and bulk of items carried and still assure that the child's clothing will be protected while feeding and that the child will be pleasantly amused both before and after feeding by an unsoiled toy device.

It is to be understood that the VELCRO fasteners 8, 18, 19, 30 and 31 can alternately be replaced with other securing means, such as snaps or buttons. It is further to be understood that while one form of this invention has been illustrated and described, it is not to be limited to the specific form or arrangement of parts, means of attachment, or composition of materials herein described and shown, except insofar as such limitations are included in the following claims.

What is claimed and desired to be secured by Letters Patent is as follows:

1. A combination bib and toy device comprising:

a) a bib body having a first size, a cutout area, top and bottom sections, left and right edges and working and nonworking sides, said cutout area located at said top section and positioned between said left and right edges, and said working side operative to protect a child from being soiled during feeding of said child;

b) a toy body having a second size that is smaller than said first size of said bib body, and front and back sides, said toy body attached to said nonworking side of said bib body between said cutout area and said bottom section of said bib body, said back side of said toy body facing said nonworking side of said bib body;

c) said bib body having means for being folded into a folded bib, said folded bib having an approximately rectangular shape;

d) a back flap having first and second ends, said first end being connected to said nonworking side of said bib body between said cutout area and said bottom section of said bib body, said second end having an attachment tab, said back flap having means for covering said folded bib, said attachment tab having means for attaching said back flap to said back side of said toy body;

e) extensions connected to said toy body and said nonworking side of said bib body and extending from said cutout area, said extensions operative to secure said bib body to said child, said extensions having front surface and rear surfaces, said rear surface having means for folding and fastening said extensions to said back side of said toy body; and f) said extensions when folded operative to form leg portions of said toy body, said nonworking side of said bib body keeping said toy body from being soiled during feeding of said child, said toy body having means for being used as a toy without exposing said child to said working side of said bib body.

2. The combination bib and toy device of claim 1 wherein said toy body has the form of a human figure.

3. The combination bib and toy device of claim 1 wherein said toy body has the form of an animal figure.

4. The combination bib and toy device of claim 1 wherein said toy body has the form of a nonhuman character.

5. A combination bib and toy device comprising:

a) a bib body having a first size, a cutout area, top and bottom sections, left and right edges and working and nonworking sides, said cutout area located at said top section and positioned between said left and right edges, said nonworking side having a joining seam positioned approximately halfway between said bottom section and said cutout area, said working side operative to protect a child from being soiled during feeding of said child;

b) a toy body having upper and torso sections and a second size, said upper and torso sections having front and back sides, said torso section being attached to said nonworking side of said bib body between said cutout area and said joining seam, said upper section connected to said torso section at said joining seam and adjacent to said bottom section of said nonworking side of said bib body, said second size including said upper and torso sections and being smaller than said first size of said bib body, said back sides of said upper and torso sections of said toy body facing said nonworking side of said bib body;

c) said bib body having means for being folded into a folded bib, said folded bib having an approximately rectangular shape;

d) a back flap having first and second ends, said first end attached to said nonworking side of said bib body at said joining seam between said upper section of said toy body and said nonworking side of said bib body, said second end having an attachment tab, said back flap having means for covering said folded bib, said attachment tab operative to hold said back flap to said back side of said torso section;

e) extensions connected to said torso section of said toy body and said nonworking side of said bib body and extending from said cutout area, said extensions operative to secure said bib body to said child, said extensions having front and rear surfaces and having means for folding and fastening said extensions to said back side of said torso section, said extensions when folded operative to form leg portions of said toy body; and f) said nonworking side of said bib body having means for covering said toy body and keeping said toy body from being soiled during a feeding of said child, said toy body having means for being used as a toy without exposing said child to said working side of said bib body.

6. The combination bib and toy device of claim 5 wherein said toy body has the form of a human figure.

7. The combination bib and toy device of claim 5 wherein said toy body has the form of an animal figure.

8. The combination bib and toy device of claim 5 wherein said toy body has the form of a nonhuman character.

9. The combination bib and toy device of claim 5 wherein said back flap has left and right side tabs, said left and right side tabs having a first means for attaching said back flap to said torso section, said attachment tab having a second means for attaching said back flap to said torso section, said attachment tab operative to be folded over said torso at said cutout area and to be aligned with said left and right side tabs, said first means for attaching being selectively connectable to said second means for attaching.

10. The combination bib and toy device of claim 9 wherein said means for folding and fastening and said first and second means for attaching includes VELCRO.

11. The combination bib and toy device of claim 9 wherein said means for folding and fastening and said first and second means for attaching includes buttons.

12. The combination bib and toy device of claim 9 wherein said means for folding and fastening and said first and second means for attaching includes snaps.

13. The combination bib and toy device of claim 6 wherein:

a) said toy body is comprised of a doll body constructed from terry cloth material and having a doll head, two doll arms, a doll torso and two doll legs formed by said extensions when folded, said doll arms having a first length that does not extend beyond said first size of said bib body, said doll legs having a second length that does not extend beyond said first size of said bib body when said doll legs are attached to said doll body;

b) said doll head, said doll arms and said doll legs are attached to said doll torso; and c) said back flap has left and right side tabs, said left and right side tabs having a first working surface with a first means for attaching said back flap to said torso section, said attachment tab having a second working surface with a second means for attaching said back flap to said torso, said attachment tab operative to be folded over said torso at said cutout area and to be aligned with said left and right side tabs, said first means for attaching is selectively connectable to said second means for attaching.

14. The combination bib and toy device of claim 13 wherein said means for holding and fastening and said first and second means for attaching includes VELCRO.

15. The combination bib and toy device of claim 13 wherein said means for holding and fastening and said first and second means for attaching includes buttons.

16. The combination bib and toy device of claim 13 wherein said means for holding and fastening and said first and second means for attaching includes snaps.

17. A combination bib and toy device comprising:

a) a bib body having a first size, a cutout area, top and bottom sections, left and right edges and working and nonworking sides, said cutout area located at said top section and positioned between said left and right edges, said nonworking side having a joining seam positioned approximately halfway between said bottom section and said cutout area, said top section having left and right top sections, said left and right top sections having fastening means attached thereto and located adjacent to said cutout area, said working side operative to protect a child from being soiled during feeding of said child;

b) a toy body having upper and torso sections and a second size, said upper and torso sections having front and back sides, said torso section being attached to said nonworking side of said bib body between said cutout area and said joining seam, said upper section being attached to said torso section at said joining seam and adjacent to said bottom section of said nonworking side of said bib body, said second size including said upper and torso sections and being smaller than said first size of said bib body, said back sides of said upper and torso sections of said toy body facing said nonworking side of said bib body;

c) said bib body having means for being folded into a folded bib, said folded bib having an approximately rectangular shape;

d) a back flap having first and second ends, said first end attached to said nonworking side of said bib body at said joining seam between said upper section of said toy body and said nonworking side of said bib body, said second end having an attachment tab, said back flap having means for covering said folded bib and said attachment tab operative to attach said back flap to said back side of said torso section;

e) extensions connected to said torso section of said toy body and said nonworking side of said bib body and extending from said cutout area, said extensions operative to secure said bib body to said child, said extensions having front and rear surfaces, said extensions having means for being folded to from leg portions of said toy body and said rear surfaces having means for holding said extensions in a folded position;

f) said back flap having left and right side tabs, said left and right side tabs having a first working surface with a first means for attaching back flap to said torso, said attachment tab having a second working surface with a second means for attaching back flap to said torso, said attachment tab operative to be folded over said torso at said cutout area and to be aligned with said left and right side tabs, said first means for attaching is selectively connectable to said second means for attaching; and g) said nonworking side of said bib body keeping said toy body from being soiled during feeding of said child, said toy body having means for being used as a toy without exposing said child to said working side of said bib body.

18. The combination bib and toy device of claim 17 wherein said toy body has the form of a human figure, and said fastening means, said means for holding and said first and second means for attaching includes VELCRO.

19. The combination bib and toy device of claim 17 wherein said toy body has the form of an animal figure, and said fastening means, said means for holding and said first and second means for attaching includes buttons.

20. The combination bib and toy device of claim 17 wherein said toy body has the form of a nonhuman character, and said fastening means, said means for holding and said first and second means for attaching includes snaps.

21. The combination bib and toy device of claim 18 wherein:

a) said toy body is comprised of a doll body constructed from terry cloth material and having a doll head, two doll arms, a doll torso and two doll legs formed by said extensions when folded, said doll arms having a first length that does not extend beyond said first size of said bib body and said doll legs having a second length that does not extend beyond said first size of said bib body; and b) said doll head, said doll arms and said doll legs are attached to said doll torso.

* * * * *